US010971858B2

(12) United States Patent
Zhan

(10) Patent No.: US 10,971,858 B2
(45) Date of Patent: Apr. 6, 2021

(54) ELECTRICAL CONNECTOR AND ELECTRICAL CONNECTOR ASSEMBLY

(71) Applicant: Tyco Electronics (Shanghai) Co. Ltd., Shanghai (CN)

(72) Inventor: Tao Zhan, Dongguan (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/727,589

(22) Filed: Dec. 26, 2019

(65) Prior Publication Data

US 2020/0212629 A1 Jul. 2, 2020

(30) Foreign Application Priority Data

Dec. 29, 2018 (CN) ..... 201822272492.6

(51) Int. Cl.

*H01R 13/62* (2006.01)
*H01R 13/633* (2006.01)
*H01R 13/639* (2006.01)
*H01R 13/627* (2006.01)

(52) U.S. Cl.

CPC ..... *H01R 13/6335* (2013.01); *H01R 13/6272* (2013.01); *H01R 13/639* (2013.01)

(58) Field of Classification Search

CPC ..... H01R 13/6335; H01R 13/639; H01R 13/6272
USPC ..... 439/155
See application file for complete search history.

(56) References Cited

U.S. PATENT DOCUMENTS 7,238,040 B1 * 7/2007 Wu ..... H01R 13/6275 439/352
7,309,250 B2 * 12/2007 Reed ..... H01R 13/6275 439/352
7,322,845 B2 * 1/2008 Regnier ..... H01R 13/6275 439/352
7,354,292 B1 * 4/2008 Lloyd ..... H01R 13/6272 439/352
7,413,473 B2 * 8/2008 Wu ..... H01R 13/6596 439/557
7,473,124 B1 * 1/2009 Briant ..... H01R 13/6275 439/352
7,666,023 B2 * 2/2010 Wu ..... H01R 13/6275 439/352

(Continued)

FOREIGN PATENT DOCUMENTS

CN 101507060 A 8/2009
CN 103579849 A 2/2014

(Continued)

*Primary Examiner* — Harshad C Patel
(74) *Attorney, Agent, or Firm* — Barley Snyder

(57) ABSTRACT

An electrical connector configured to be inserted into a mating connector in an insertion direction includes a housing having a receiving passage, a locking mechanism, and a releasing mechanism. The locking mechanism is rotatably mounted on a top wall of the housing by a pivot and has a locking portion. The locking portion is inserted into a mating housing of the mating connector to lock the electrical connector and the mating connector. The releasing mechanism provides a releasing force to drive the locking mechanism to move from a locked state to a released state to allow the electrical connector to be disengaged from the mating connector.

20 Claims, 13 Drawing Sheets

(56) References Cited

U.S. PATENT DOCUMENTS

| | | | | |
|---|---|---|---|---|
| 8,231,400 | B2 * | 7/2012 | Phillips | G02B 6/4284 439/357 |
| 8,506,319 | B2 * | 8/2013 | Ritter | H01R 13/6335 439/352 |
| 8,926,347 | B2 * | 1/2015 | Zhu | H01R 13/62 439/159 |
| 9,246,262 | B2 * | 1/2016 | Brown | H01R 13/62 |
| 9,761,998 | B2 * | 9/2017 | De Dios Martin | H01R 13/6272 |
| 9,991,635 | B2 * | 6/2018 | De Dios Martin | H01R 13/6335 |
| 10,270,209 | B2 | 4/2019 | Resendez et al. | |
| 10,665,991 | B2 * | 5/2020 | Li | H01R 13/6275 |
| 10,700,460 | B2 * | 6/2020 | Li | H01R 43/24 |
| 2010/0216325 | A1 * | 8/2010 | Huang | H01R 13/6275 439/155 |
| 2012/0021627 | A1 * | 1/2012 | Wang | H01R 13/6582 439/159 |
| 2012/0149222 | A1 * | 6/2012 | Wu | H01R 13/6275 439/155 |
| 2012/0302078 | A1 * | 11/2012 | Yang | H01R 13/6335 439/155 |
| 2015/0244109 | A1 * | 8/2015 | Byczkiewicz | H01R 13/6335 439/352 |
| 2017/0205591 | A1 | 7/2017 | Takano et al. | |

FOREIGN PATENT DOCUMENTS

| | | | |
|---|---|---|---|
| CN | 107408782 | A | 11/2017 |
| WO | 2009065051 | A1 | 5/2009 |

* cited by examiner

ELECTRICAL CONNECTOR AND ELECTRICAL CONNECTOR ASSEMBLY

CROSS-REFERENCE TO RELATED APPLICATION

This application claims the benefit of the filing date under 35 U.S.C. § 119(a)-(d) of Chinese Patent Application No. 201822272492.6, filed on Dec. 29, 2018.

FIELD OF THE INVENTION

The present invention relates to an electrical connector and, more particularly, to an electrical connector with a locking mechanism.

BACKGROUND

In a conventional electrical connector assembly, an electrical connector is locked to a mating connector for a stable electrical connection therebetween. A restoring force is provided by an elastic member, typically by a spring, to act on a locking mechanism such that the electrical connector can be unlocked from the mating connector.

In some electrical connectors, however, after a locking portion of the locking mechanism is inserted into the mating connector, a large force is required to be applied to a releasing mechanism for unlocking the locking portion from the mating connector. The large required force is not only inconvenient for use, but also causes the locking portion to be easily deformed or worn in the case of long-term use, reducing a service life of the electrical connector or the electrical connector assembly.

In addition, in some electrical connectors, the spring is vertically disposed in a recess recessed into a receiving passage and located below the locking mechanism. The position of the spring causes the receiving passage to become narrow, and it is thus difficult to accommodate or mount wires within the receiving passage, increasing difficulty of using the electrical connector or electrical connector assembly and reducing utility of the electrical connector or electrical connector assembly.

SUMMARY

An electrical connector configured to be inserted into a mating connector in an insertion direction includes a housing having a receiving passage, a locking mechanism, and a releasing mechanism. The locking mechanism is rotatably mounted on a top wall of the housing by a pivot and has a locking portion. The locking portion is inserted into a mating housing of the mating connector to lock the electrical connector and the mating connector. The releasing mechanism provides a releasing force to drive the locking mechanism to move from a locked state to a released state to allow the electrical connector to be disengaged from the mating connector.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
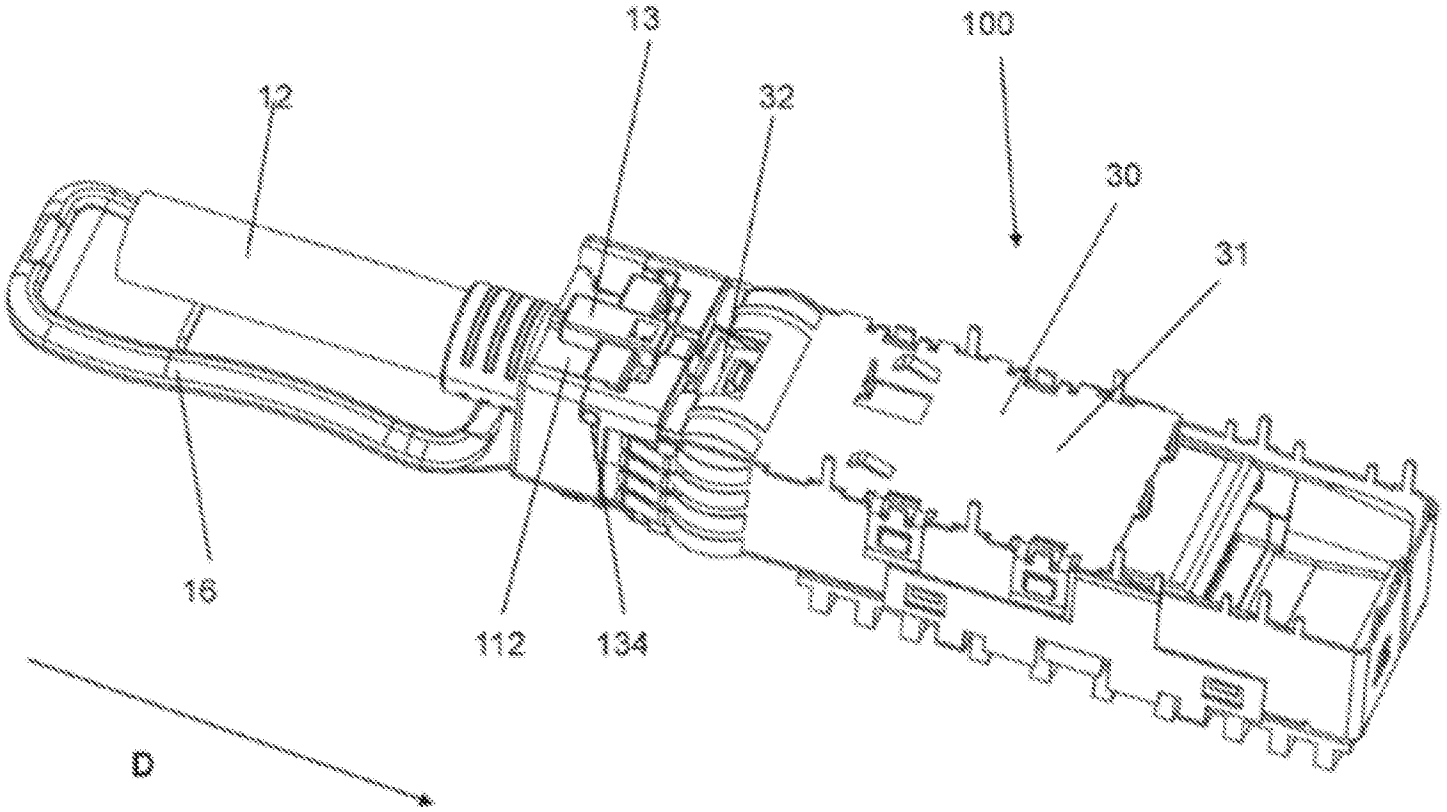
FIG. 1 is a perspective view of an electrical connector assembly according to an embodiment.

The technical solutions of the present disclosure will be further specifically described below by way of embodiments and with reference to the accompanying drawings. In the specification, the same or similar reference numerals indicate the same or similar components. The description of the embodiments of the present disclosure with reference to the accompanying drawings is intended to explain the general inventive concept of the present disclosure, and should not be construed as a limitation to the present disclosure. In addition, in the following detailed description, numerous specific details are set forth to facilitate explanation so as to provide a comprehensive understanding of embodiments of the disclosure. However, one or more embodiments may be practiced without these specific details.

As shown in FIGS. 1-5, an electrical connector 10 according to an embodiment can be inserted into a mating connector 30 in an insertion direction D so as to form an electrical connector assembly 100. The electrical connector 10 comprises a housing 11 having a receiving passage 111 for receiving wires (not shown) of a cable 12 inserted therein and a first circuit board (not shown) electrically connected with the wires, a locking mechanism 13 rotatably mounted onto a top wall 112 of the housing 11 by a pivot 134 and comprising a locking portion, which is inserted into a mating housing 31 of the mating connector 30 so as to achieve locking between the electrical connector 10 and the mating connector 30, and a releasing mechanism 16 configured to provide a releasing force to drive the locking mechanism 13 to move from a locked state to a released state so as to allow the electrical connector 10 to be disengaged from the mating connector 30. Because the locking mechanism 13 is rotatably mounted onto the top wall 112 of the housing 11 by the pivot 134, it is rotatably movable from the locked state to the released state, and vice versa, without applying any larger force onto the releasing mechanism 16 to unlock the locking portion from the mating connector 30, improving the service life of the electrical connector 10 or the electrical connector assembly 100.

In an embodiment, the electrical connector 10 comprises a retaining mechanism configured to maintain the locking mechanism 13 in the locked state.

Figure 6:
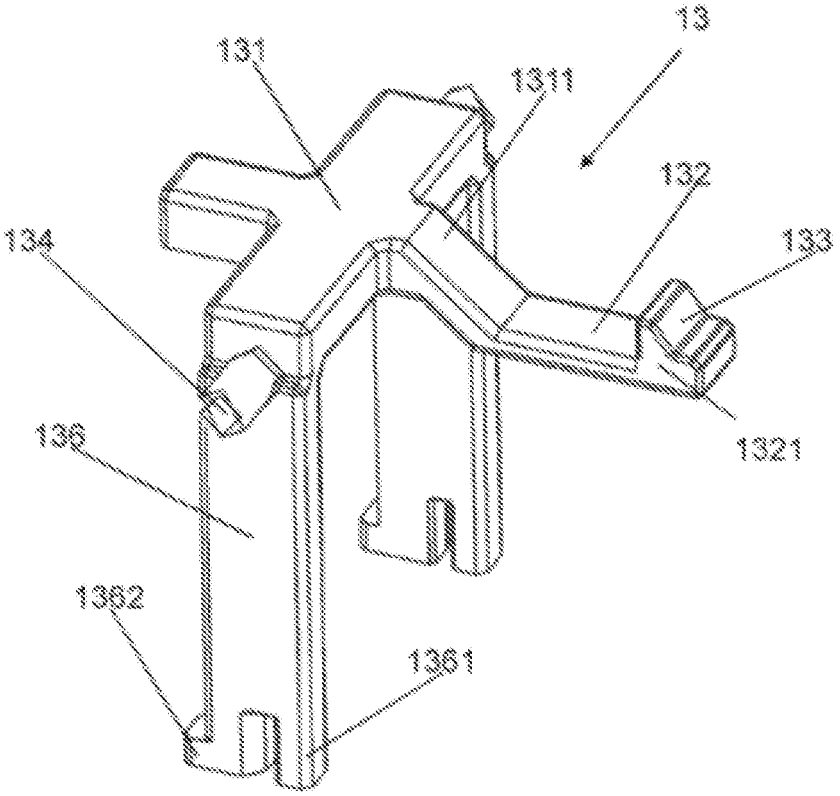
FIG. 6 is a perspective view of a locking mechanism of the electrical connector of FIG. 4.

As shown in FIG. 6, the locking mechanism 13 includes a body 131, the body 131 being mounted to an exterior of the top wall 112 of the housing 11 by the pivot 134 so as to be pivotal about an axis in a lateral direction perpendicular to the insertion direction D. The locking portion is connected to a first side 1311 of the body 131 and includes a locking arm 132 extending from the first side 1311 of the body 131 in the insertion direction D and a locking protrusion 133 disposed at a free end 1321 of the locking arm 132. The locking protrusion 133 is configured to be inserted inside a mating housing 31 of the mating connector 30 and into a locking groove 321 of the mating housing 31 so as to achieve locking between the electrical connector 10 and the mating connector 30.

Figure 5:
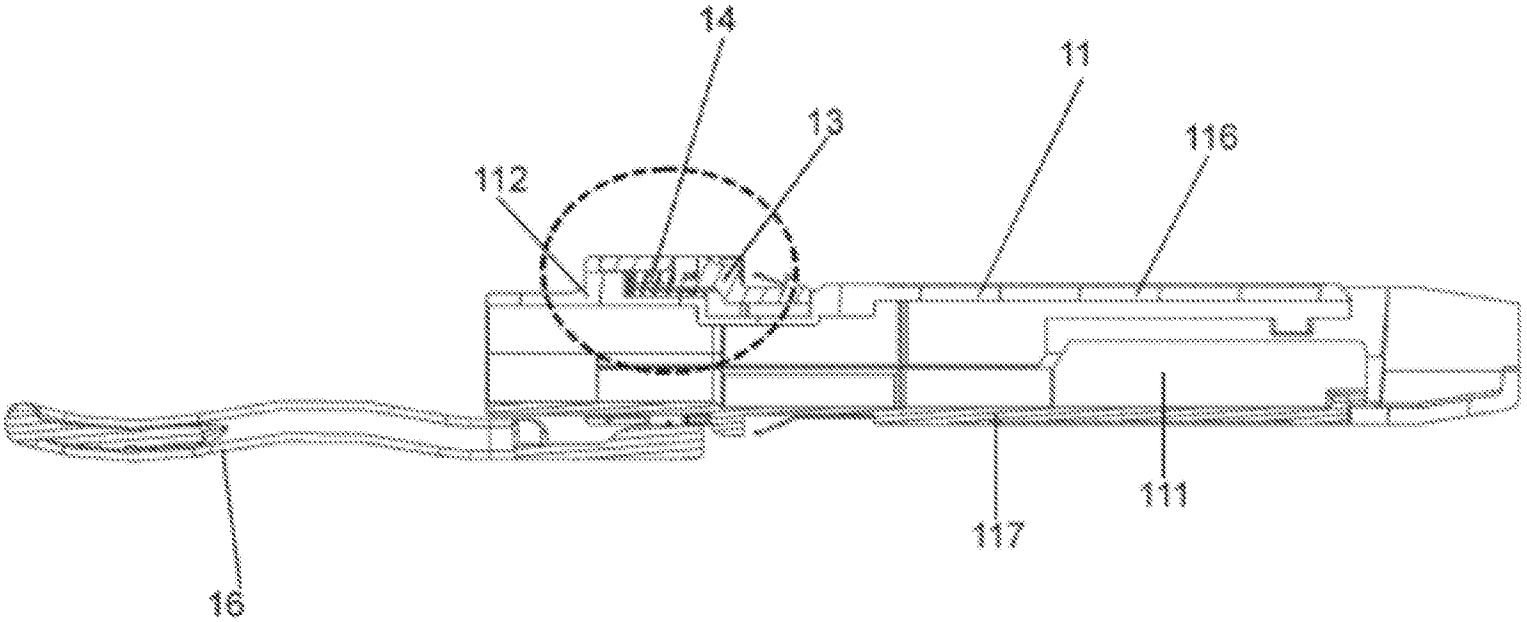
FIG. 5 is a sectional side view of the electrical connector of FIG. 3.
Figure 9:
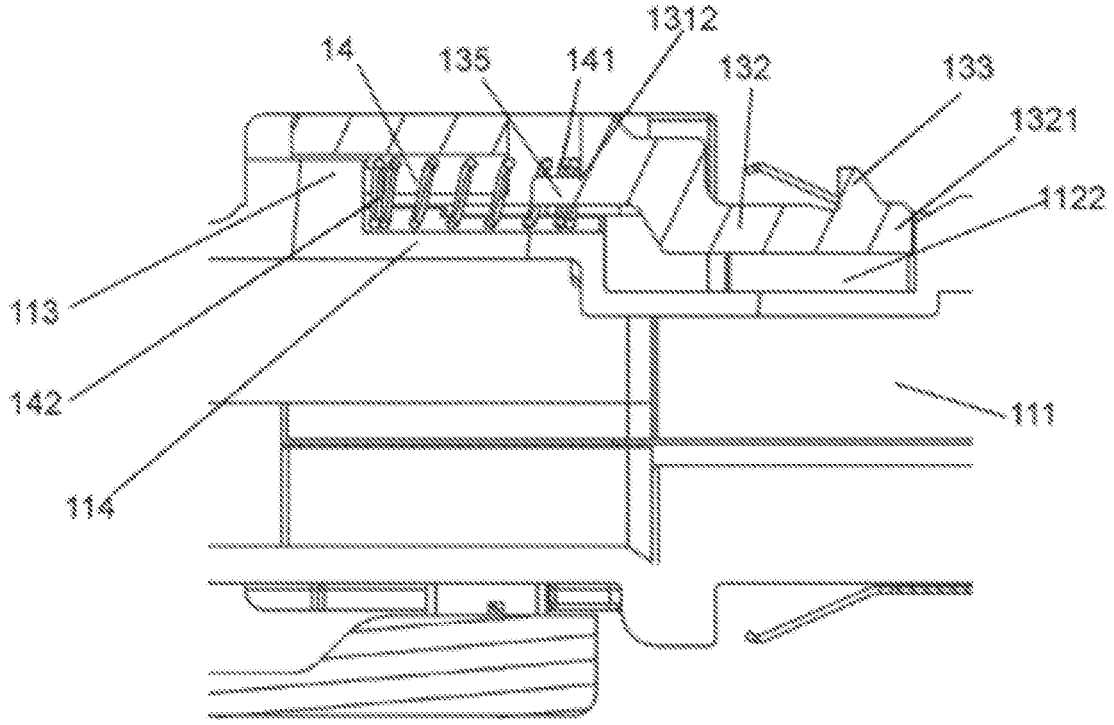
FIG. 9 is an enlarged sectional side view of a portion within a circle of FIG. 5.

As shown in FIGS. 5 and 9, the top wall 112 of the housing 11 has a receiving groove 1122, which for example is downwardly recessed in the shown embodiments. The locking arm 132 is received in the receiving groove 1122 so that when the locking arm 132 is moved downward, the locking mechanism 13 is driven to rotate to move to the released state.

As shown in FIG. 6, the locking mechanism 13 includes a pair of legs 136 extending respectively downward from a pair of opposite ends of the body 131 to positions below a bottom wall of the housing 11. The releasing mechanism 16 is connected to a pair of free ends 1361 of the legs 136 at a position below the bottom wall of the housing 11, so as to drive the locking mechanism 13 to move from the locked state to the released state by pulling the free ends 1361 in a direction opposite to the insertion direction D.

Figure 7:
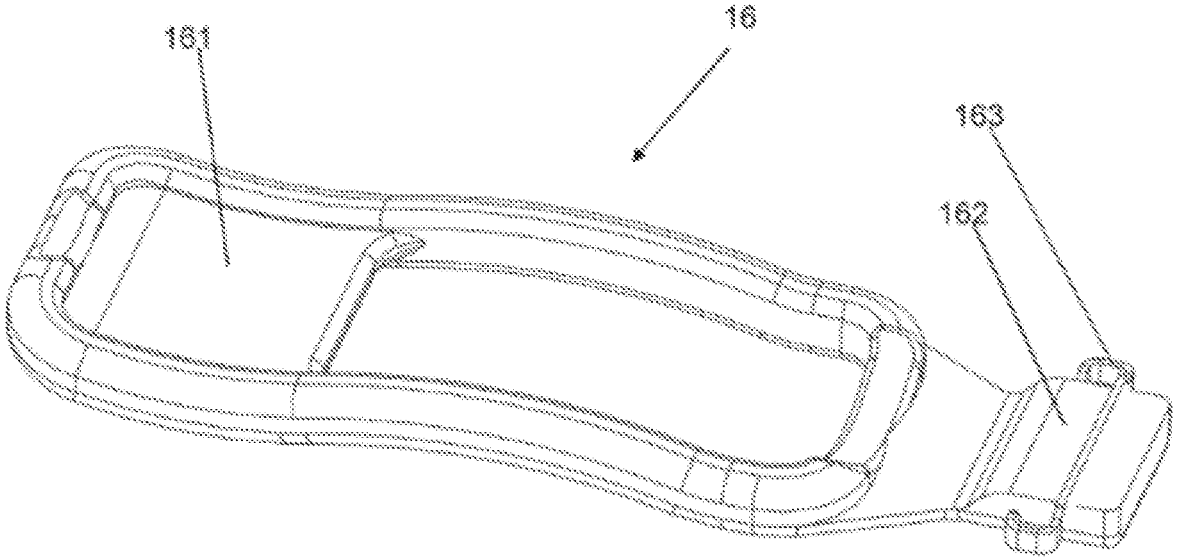
FIG. 7 is a perspective view of a releasing mechanism of the electrical connector of FIG. 4.

As shown in FIG. 7, the releasing mechanism 16 has an actuating portion 161 shaped to be pulled by an external tool, for example, shaped into a partially hollow structure having a rectangular section, and a connecting portion 162 connected to the actuating portion 161. The connecting portion 162 is configured to be connected to the free ends 1361 of the legs 136 of the locking mechanism 13 at a position below the bottom wall of the housing 11 to provide the releasing force to the locking mechanism 13 so as to unlock the electrical connector 10 from the mating connector 30.

The connecting portion 162, as shown in FIG. 7, has a pair of annular ears 163 configured to be connected to the free ends 1361 of the legs 136. As shown in FIG. 6, each of the free ends 1361 has a securing projection to prevent the annular ear 163 from disengaging therefrom.

As shown in FIGS. 5 and 9, the retaining mechanism has an elastic member 14 extending in a direction parallel to the insertion direction D. A first end 141 of the elastic member 14 abuts against a second side 1312 of the body 131 of the locking mechanism 13 opposite to the first side 1311 and an opposite second end 142 of the elastic member 14 abuts against a base 113 projecting outwardly from an outer wall 114 of the housing 11, so that when the releasing force acting on the locking mechanism 13 disappears, the compressed elastic member 14 elongates to provide a restoring force so as to drive the locking mechanism 13 to move to the locked state. Because the elastic member 14 is horizontally disposed below the body 131 of the locking mechanism 13 to abut against the second side 1312 of the body 131 of the locking mechanism 13 so as to provide a horizontal restoring force, instead of being vertically disposed in the receiving groove 1122 to abut against the locking arm 132 to provide a restoring force in a vertical direction, the receiving groove 1122 does not have to be recessed into the receiving passage 111 or does not have to be recessed too much into the receiving passage 111, as long as the locking arm 132 may be allowed to move downward to unlock the electrical connector 10 from the mating connector 30. Because the receiving groove 1122 need not be recessed into the receiving passage 111 or need not be recessed too much into the receiving passage 111, the receiving passage 111 is prevented from becoming otherwise narrow, so that it is easy to accommodate or mount the wires in the receiving passage 111, facilitating the electrical connection between the electrical connector 10 and the mating connector and increasing the utility of the electrical connector 10 or electrical connector assembly 100. In this embodiment, the elastic member 14 is a spring, however this is not limitative and the elastic member 14 may have any form that can provides a restoring force.

As shown in FIG. 9, a connecting arm 135 extends from the second side 1312 of the body 131 in the direction opposite to the insertion direction D. The connecting arm 135 is configured to be inserted into an end of the elastic member 14, so as to enhance the connection with the elastic member 14.

Figure 4:
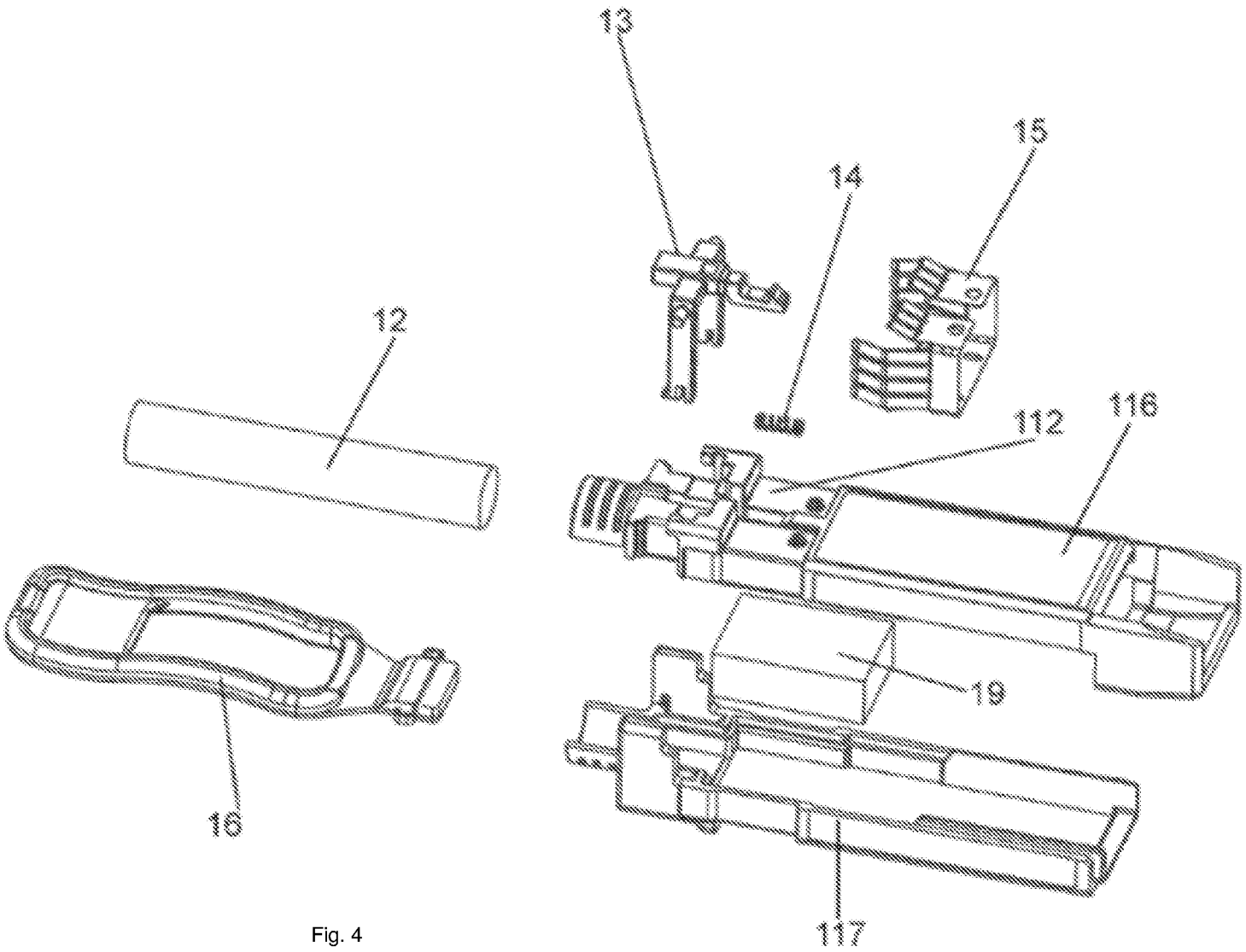
FIG. 4 is an exploded perspective view of the electrical connector of FIG. 3.
Figure 8:
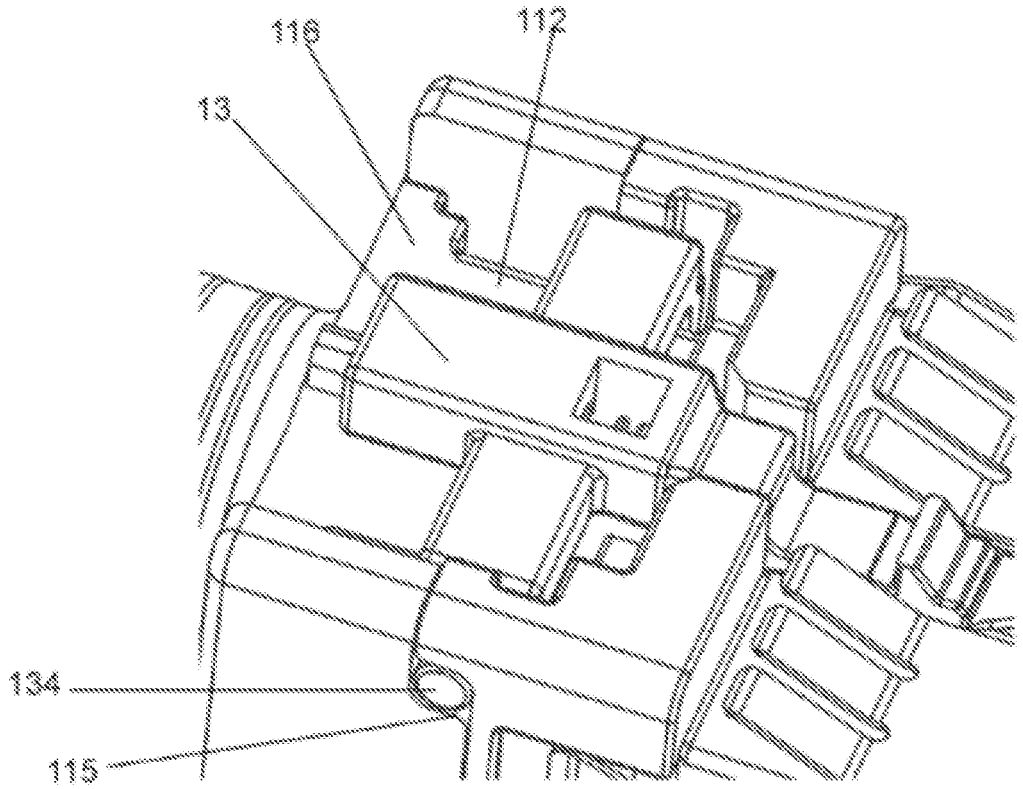
FIG. 8 is an enlarged perspective view of a portion within a circle of FIG. 3.

As shown in FIG. 4, the housing 11 comprises an upper housing 116, on which a body 131 of the locking mechanism 13 is disposed, and a lower housing 117 assembled to the upper housing 116 to define the receiving passage 111. Two opposing through holes 115, shown in FIG. 8, are formed in the upper housing 116 and the lower housing 117, and the pivot 134 is installed in the through holes 115.

The housing 11 is assembled from two separate components, namely, the upper housing 116 and the lower housing 117, so as to facilitate the installation of the cable 12 and its wires into the electrical connector 10. Firstly, the wires extending from the cable 12 are electrically connected to corresponding terminals of the first circuit board, and then the wires are passed through a plastic, the plastic is formed or shaped to fix the wires such that the wires do not move relative to one another, and then the wires and the first circuit board, which are electrically connected to each other, are placed in the lower housing 117. Then, the upper housing 116 is fitted to the lower housing 117 such that the wires and the first circuit board electrically connected to each other are received in the receiving passage 111. The plastic may be shaped according to the receiving passage 111 or corresponding component that receives the wires, facilitating the cable 12 and the first circuit board to be mounted in the electrical connector 10. In an embodiment, the corresponding component is, for example, a hollow casing that is disposed in the receiving passage 111, and the wires of the cable 12 that are secured by the plastic are inserted into the casing to be positioned in the receiving passage 111.

Figure 2:
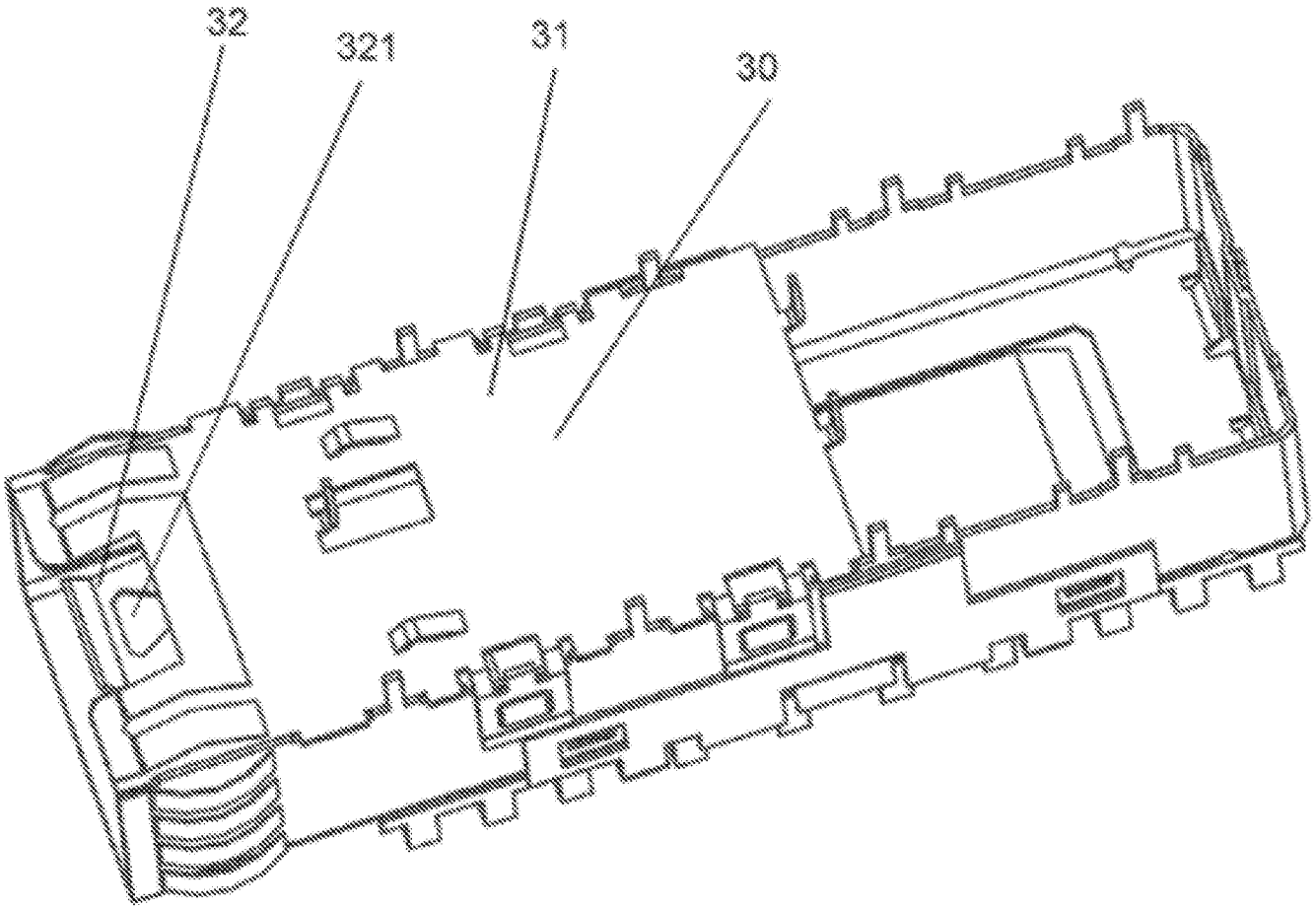
FIG. 2 is a perspective view of a mating connector of the electrical connector assembly of FIG. 1.
Figure 3:
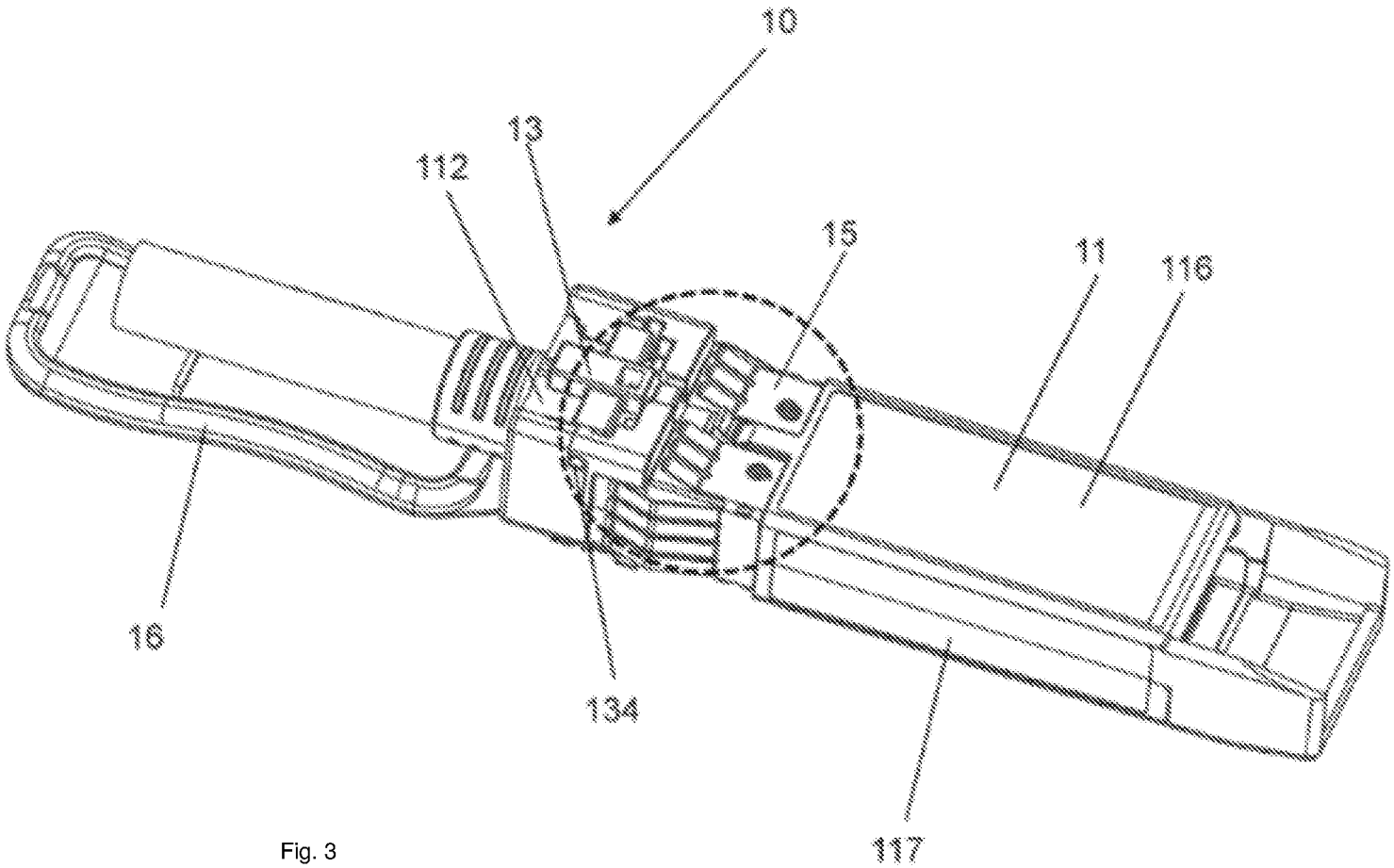
FIG. 3 is a perspective view of an electrical connector of the electrical connector assembly of FIG. 1.
Figure 12:
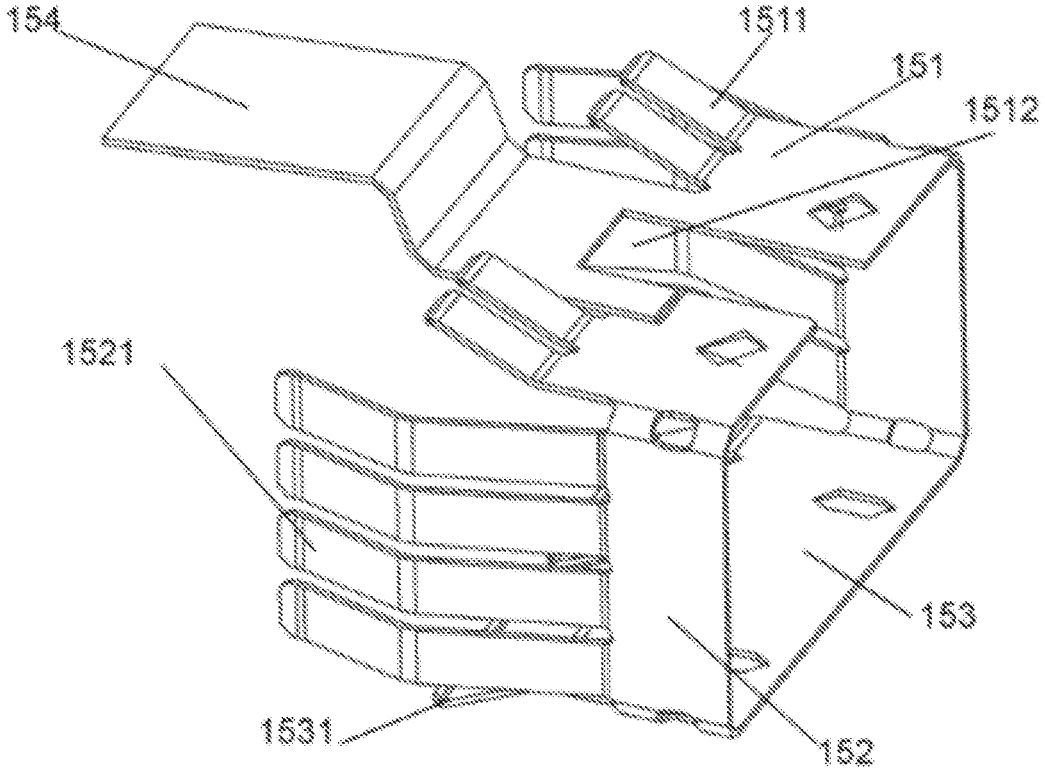
FIG. 12 is a perspective view of a shielding case of the electrical connector of FIG. 10.
Figure 13:
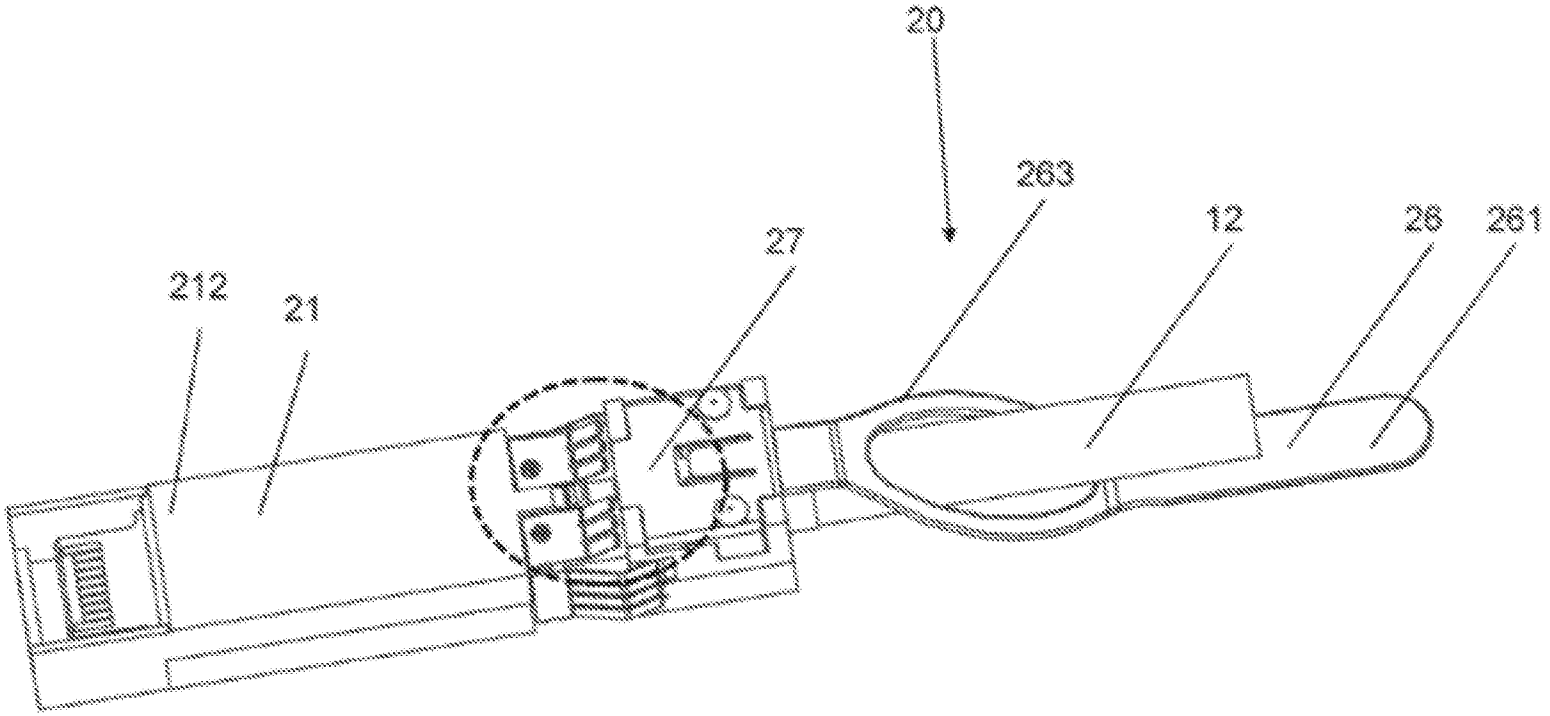
FIG. 13 is a perspective view of an electrical connector according to another embodiment.

As shown in FIG. 12, in an embodiment, the electrical connector 10 comprises a shielding case 15 disposed around the housing 11 and shaped to be mated with the mating connector 30, so as to prevent signal transmission in the electrical connector 10 from being subjected to external electromagnetic interference. The shielding case 15 includes a pair of horizontal top plates 151, a pair of vertical side plates 152 and a horizontal bottom plate 153. The top plates 151 are oppositely disposed and spaced apart from each other. The free end 1321 of the locking arm 132 is located in a gap 1512 between the top plates 151 so as to facilitate locking the electrical connector 10 to the mating connector 30, and the top plates 151 are respectively provided with first fingers 1511 spaced apart from one another and extending obliquely upward. The vertical side plates 152 are oppositely disposed and extend respectively downwardly from the top plates 151, and the side plates 152 are respectively provided with a plurality of second fingers 1521 spaced apart from one another and each formed into a "V" shape. The horizontal bottom plate 153 is connected between the side plates 152 and opposite to the top plates 151. The bottom plate 153 has a plurality of third fingers 1531 spaced apart from one another and extending obliquely downward. These fingers not only enhance the electromagnetic shielding capability of the shielding case 15, but also enhance the mating connection of the shielding case 15 with the mating housing 31, as shown in FIGS. 1-2.

Figure 10:
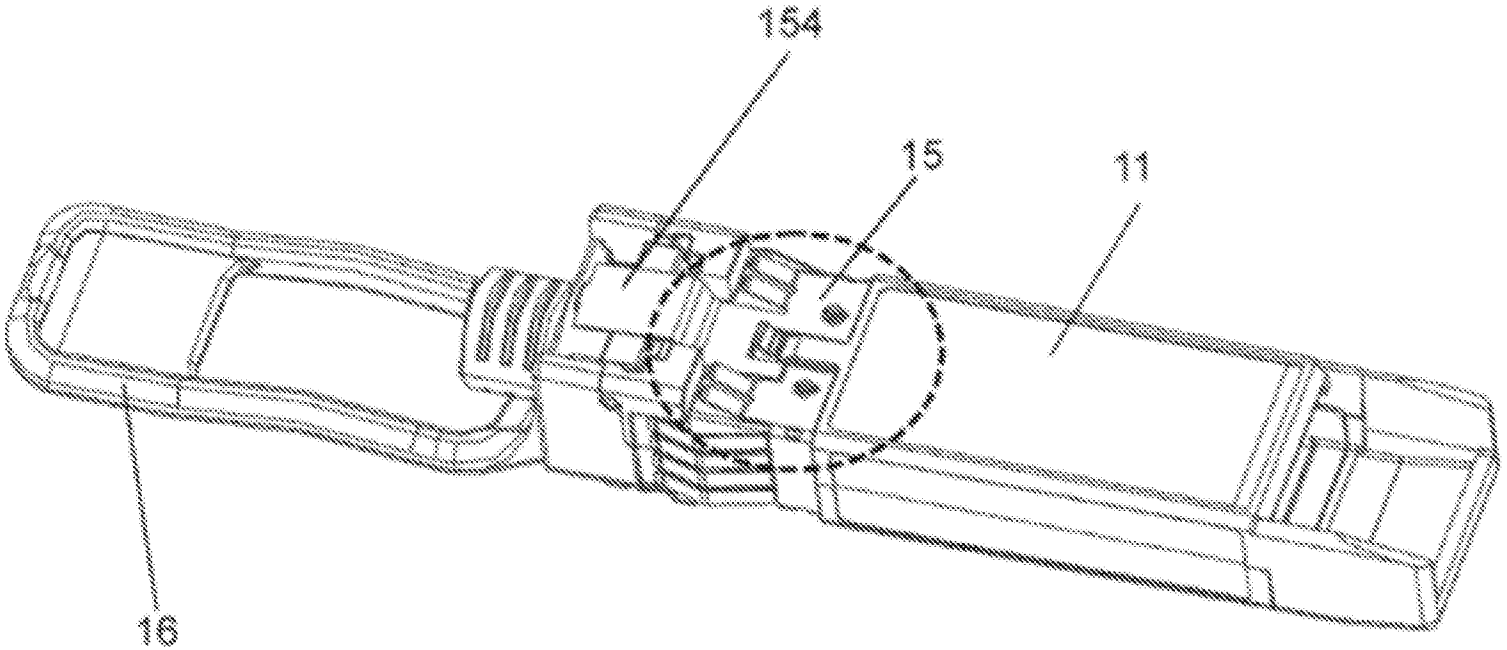
FIG. 10 is a perspective view of an electrical connector according to another embodiment.
Figure 11:
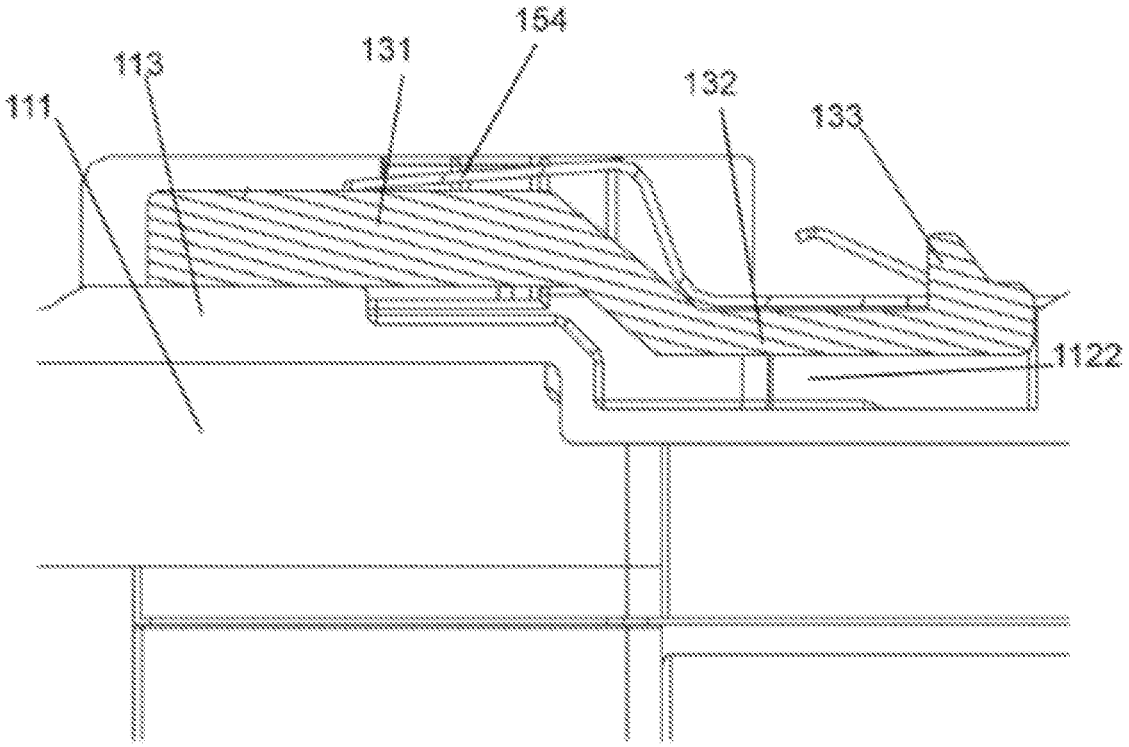
FIG. 11 is a sectional side view of a portion within a circle of FIG. 10.

As shown in FIGS. 10-12, the shielding case 15 has an elastic arm 154 extending above the body 131 from the top plates 151 in the direction opposite the insertion direction D. When the locking mechanism 13 is pulled by the releasing mechanism 16 to rotate downward, for example in a clockwise direction, a downward restoring force is applied toward the locking mechanism 13 by the elastic arm 154, so that in the case where the releasing force acting on the locking mechanism 13 disappears, the locking mechanism 13 is driven by the restoring force to rotate upward, for example in a counterclockwise direction, to the locked state. The elastic arm 154 replaces the elastic member 14 to provide the restoring force without the need to provide a separate elastic member 14 in the electrical connector 10, further simplifying the structure of the electrical connector assembly 100.

In another embodiment shown in FIGS. 13-18, an electrical connector 20 is configured to be inserted into a mating connector 30 in an insertion direction D to form an electrical connector assembly 100. The electrical connector 20 includes a housing 21 having a receiving passage 211 for receiving wires (not shown) of a cable 12 inserted therein and a first circuit board (not shown) electrically connected to the wires, a locking mechanism 23 rotatably mounted on a top wall 212 of the housing 21 by a pivot 234 and having a locking portion 232 that is inserted into the mating housing 31 of the mating connector 30 so as to achieve locking between the electrical connector 20 and the mating connector 30, and a releasing mechanism 26. The releasing mechanism 26 provides a releasing force to drive the locking mechanism 23 to move from the locked state to a released state, so as to allow the electrical connector 20 to be separated or disengaged from the mating connector 30. Because the locking mechanism 23 is rotatably mounted on the top wall 212 of the housing 21 by the pivot 234, the locking mechanism 23 is rotatably movable from the locked state to the released state, and vice versa, without applying any larger force to the releasing mechanism 26 to unlock the locking portion 232 from the mating connector 30, improving the service life of the electrical connector 20 or the electrical connector assembly 100.

Figure 15:
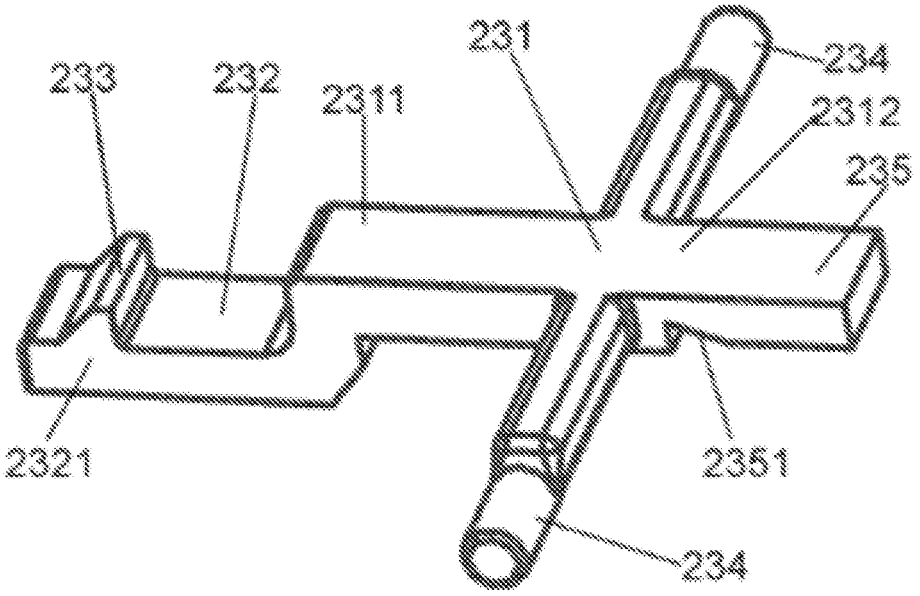
FIG. 15 is a perspective view of a locking mechanism of the electrical connector of FIG. 14.

As shown in FIG. 15, the locking mechanism 23 has a body 231, which is mounted to an exterior of the top wall 212 of the housing 21 by the pivot 234 in such a way that it is pivotal about an axis in a lateral direction perpendicular to the insertion direction D. The locking portion 232 is connected to a first side 2311 of the body 231 and includes a locking arm 232 that extends from the first side 2311 of the body 231 in the insertion direction D and a locking protrusion 233 provided at a free end 2321 of the locking arm 232 and configured to be inserted in the mating housing 31 of the mating connector 30 and into a locking groove 321 of the mating housing 31 so as to achieve locking between the electrical connector 20 and the mating connector 30.

The locking mechanism 23, as shown in the embodiment of FIG. 15, has a releasing arm 235 extending in a direction opposite to the insertion direction D from a second side 2312 of the body 231 opposite to the first side 2311. The releasing mechanism 26 is connected to the releasing arm 235 so as to drive the locking mechanism 23 to move from the locked state to the released state by driving the releasing arm 235.

Figure 18:
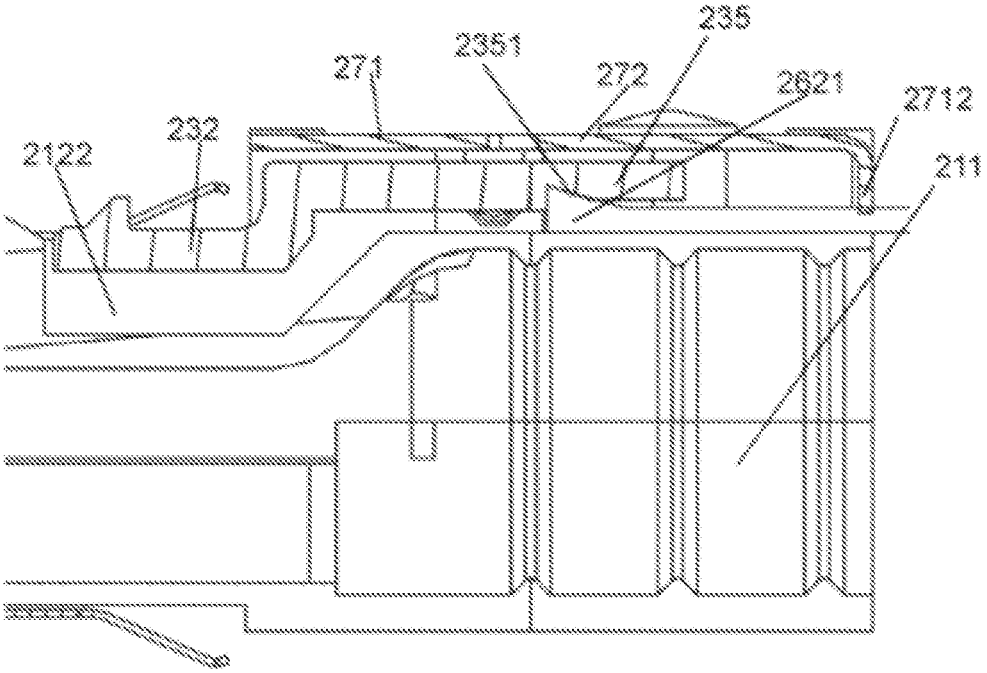
FIG. 18 is a sectional side view of the portion within the circle of FIG. 13.

As shown in FIG. 18, the top wall 212 of the housing 21 has a downwardly recessed receiving groove 2122. The locking arm 232 is received in the receiving groove 2122 to facilitate the locking arm 232 to move downward, causing the locking mechanism 23 to rotate to move to the released state.

Figure 14:
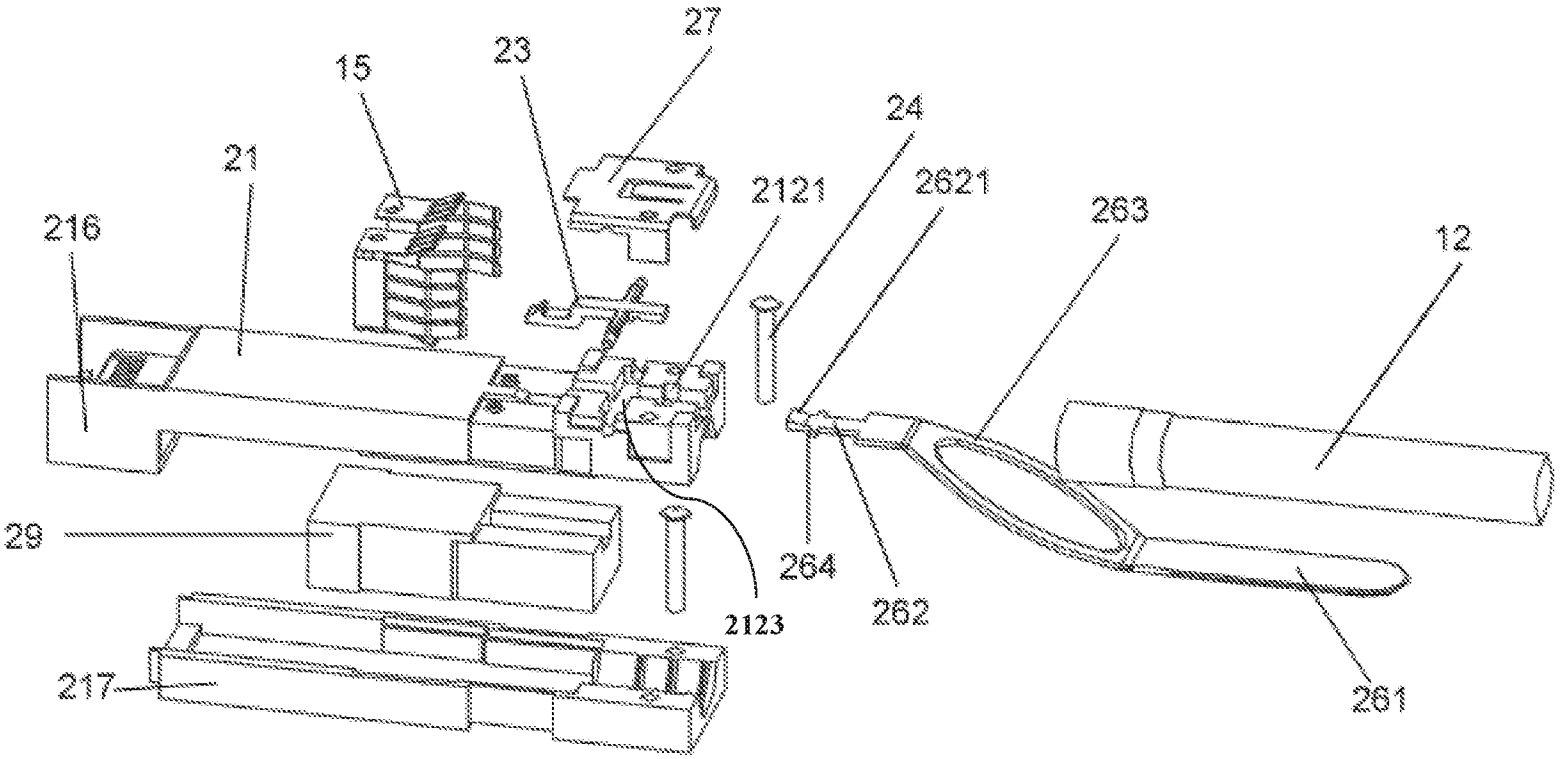
FIG. 14 is an exploded perspective view of the electrical connector of FIG. 13.

As shown in FIGS. 14-15, a lower side of the releasing arm 235 has a fitting groove 2351, and the releasing mechanism 26 has an actuating portion 261 shaped to be pulled by an external tool and a driving portion 262 connected to the actuating portion 261. A free end of the driving portion 262 has a wedge-shaped protrusion 2621 which projects obliquely upward in the direction opposite to the insertion direction D. The wedge-shaped protrusion 2621 is at least partially received or mated in the mating groove 2351 to drive the releasing arm 235 to rotate upward, for example in a counterclockwise direction, in response to movement of the actuating portion 261 in the direction opposite to the insertion direction D, as shown in FIG. 18, thereby driving the lock mechanism 23 to move from the locked state to the released state.

As shown in FIG. 14, the releasing mechanism 26 has a hollow annular portion 263 obliquely disposed between the actuating portion 261 and the driving portion 262, and a cable 12 to be inserted into the housing 21 extends through the hollow annular portion 263.

The releasing mechanism 26, as shown in FIG. 14, has a pair of limiting protrusions 264 protruding outward from two opposite sides of the driving portion 262 in a direction perpendicular to the insertion direction D, respectively. A pair of limiting grooves 2121 are formed on the top wall 212 of the housing 21, respectively, and the limiting protrusions 264 are received in the limiting grooves 2121, respectively, so as to limit a moving distance of the releasing mechanism 26 in a direction parallel to the insertion direction D.

Figure 16:
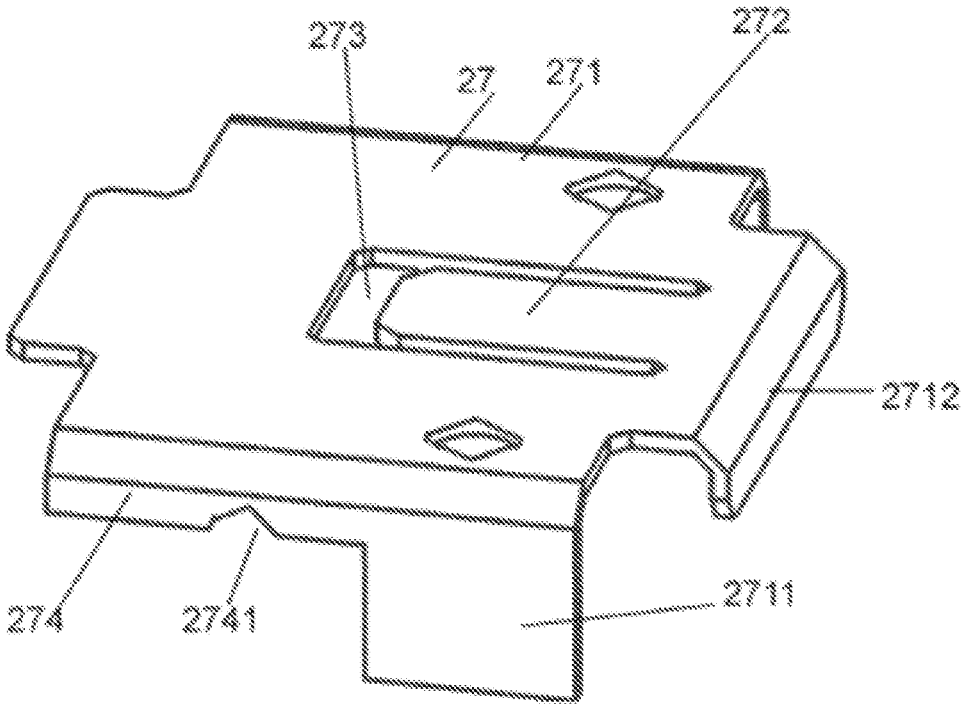
FIG. 16 is a perspective view of a limiting cover of the electrical connector of FIG. 14.
Figure 17:
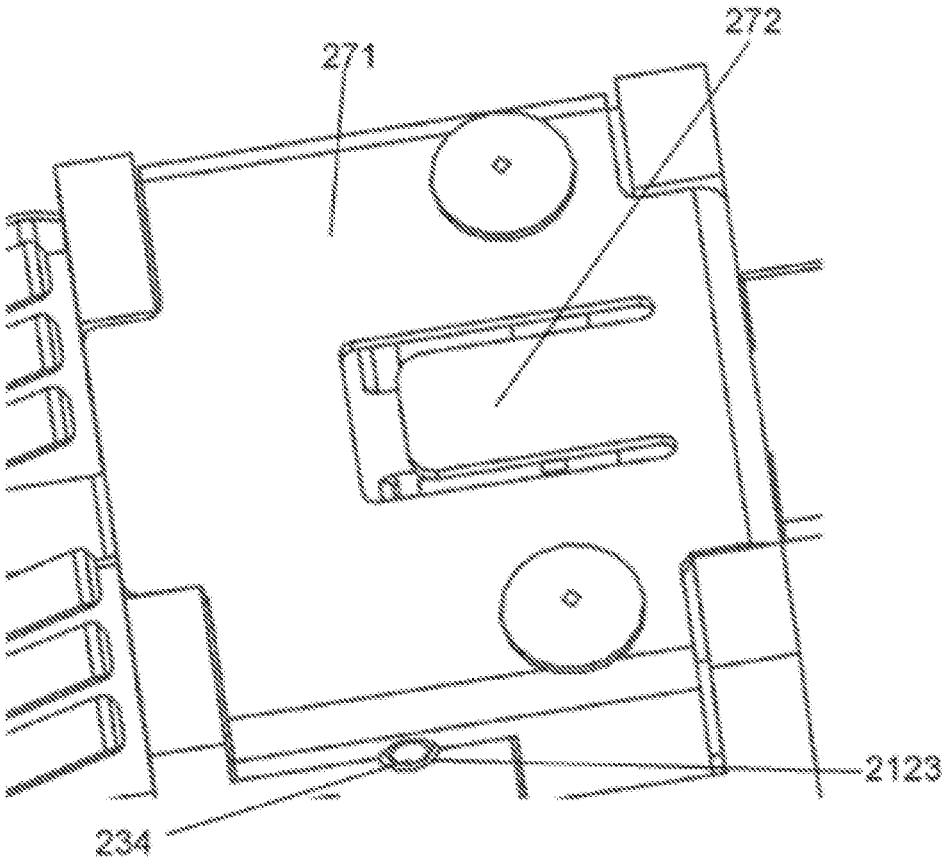
FIG. 17 is a perspective view of a portion within a circle of FIG. 13.

As shown in FIGS. 14 and 16, the electrical connector 20 comprises a limiting cover 27 fixed to the housing 21 by a pair of bolts 24. The limiting cover 27 has a horizontal cover body 271. The horizontal cover body 271 is mounted over the outer wall of the housing 21 so as to retain the pivot 234 of the locking mechanism 23 in a mounting slot 2123 formed in an outer side or face of the top wall 212 of the housing 21.

The limiting cover 27, as shown in FIG. 16, has a limiting elastic piece 272 disposed in an opening 273 formed in the cover body 271 and extending above the locking arm 232 of the locking mechanism 23 in the insertion direction D. When the releasing force acting on the locking mechanism 23 disappears or is removed, the limiting elastic piece 272 abuts against the upwardly rotating releasing arm 235 to apply a restoring force onto the releasing arm, so as to drive the locking mechanism 23 to move to the locked state. This also makes it possible to prevent the elastic member from being vertically disposed in the receiving groove 2122 to provide the restoring force, so that the receiving groove 2122 needs not to be recessed into the receiving passage 211 or needs not to be recessed too much into the receiving passage 211, facilitating receiving or mounting the wires in the receiving passage 211.

As shown in FIG. 16, the limiting cover 27 has a pair of side walls 274 extending downwardly from two opposite sides of a body of the limiting cover 27 and having a pair of limiting notches 2741 opening downwards, respectively. The two limiting notches 2741 cooperate with the mounting slots 2123 formed outside the top wall 212 of the housing 21, so as to retain the pivot 234 between the limiting cover 27 and the housing 21.

In an embodiment, the housing 21 may also be assembled from two separate components, an upper housing 216 and a lower housing 217 shown in FIG. 14, to facilitate mounting the cable 12 and its wires in the electrical connector 20.

In an embodiment, the electrical connector 20 has a shielding case 15 disposed about the housing 21 and shaped to mate with the mating connector 30, so as to prevent signal transmission in the electrical connector 20 from being subjected to external electromagnetic interference.

In the embodiment shown in FIG. 14, the electrical connector 20 has a hollow casing 29 disposed in the receiving passage 211, so that wires of a cable fixed by plastic are inserted into the casing so as to be positioned into the receiving passage 211, as described in the previous embodiments.

An electrical connector assembly 100 according to an embodiment comprises an electrical connector 10 or 20 described according to any of the preceding embodiments, and a mating connector 30 having a mating housing 31 to be secured onto a second circuit board (not shown). The mating housing 31 has a mating locking mechanism 32, the electrical connector 10 or 20 is inserted into the mating connector 30, and the locking mechanism 23 is connected or engaged with the mating locking mechanism 32 to lock the electrical connector 10 or 20 with the mating connector 30, so that the second circuit board is electrically connected to the first circuit board within the receiving passage 111 or 211 of the electrical connector 10 or 20.

It will be understood by those skilled in the art that the embodiments described above are exemplary and may be modified by those skilled in the art, and the structures described in the various embodiments may be combined freely without conflict in structure or principle thereof. In light of the described embodiments, various changes and modifications may be made without departing from the scope and spirit of the appended claims. The present disclosure is not limited to the implementation of the exemplary embodiments set forth in the specification.

What is claimed is:

1. An electrical connector configured to be inserted into a mating connector in an insertion direction, comprising:

a housing having a receiving passage;

a locking mechanism rotatably mounted on a top wall of the housing by a pivot and having:

a body mounted to an exterior of the top wall of the housing by the pivot and pivotal in a lateral direction perpendicular to the insertion direction;

a locking portion connected to a first side of the body for engaging with the mating connector to lock the electrical connector and the mating connector; and a pair of legs extending downwardly from a pair of opposite ends of the body and toward a bottom wall of the housing; and a releasing mechanism connected to a pair of free ends of the leg, the releasing mechanism providing a releasing force to drive the locking mechanism to move from a locked state to a released state to allow the electrical connector to be disengaged from the mating connector, the releasing mechanism driving the locking mechanism to move from the locked state to the released state by pulling the free ends in a direction opposite to the insertion direction.

2. The electrical connector of claim 1, further comprising a retaining mechanism retaining the locking mechanism in the locked state.

3. An electrical connector configured to be inserted into a mating connector in an insertion direction, comprising:

a housing having a receiving passage;

a locking mechanism rotatably mounted on a top wall of the housing by a pivot and having:

a body mounted to an exterior of the top wall of the housing by the pivot and pivotal in a lateral direction perpendicular to the insertion direction; and a locking portion connected to a first side of the body for engaging with the mating connector to lock the electrical connector and the mating;

a releasing mechanism providing a releasing force to drive the locking mechanism to move from a locked state to a released state to allow the electrical connector to be disengaged from the mating connector; and a retaining mechanism retaining the locking mechanism in the locked state, wherein the retaining mechanism has an elastic member extending in a direction parallel to the insertion direction, a first end of the elastic member abuts against a second side of the body of the locking mechanism opposite to the first side and a second end of the elastic member abuts against a base projecting outwardly from an outer wall of the housing, the elastic member being elastically compressed and elastically expanded in directions parallel to the insertion direction for driving the locking mechanism to move to the locked state in response to a removal of the releasing force acting on the locking mechanism.

4. The electrical connector of claim 3, wherein a connecting arm extends from the second side of the body in a direction opposite to the insertion direction, the connecting arm inserted into the first end of the elastic member.

5. An electrical connector configured to be inserted into a mating connector in an insertion direction, comprising:

a housing having a receiving passage;

a locking mechanism rotatably mounted on a top wall of the housing by a pivot and having:

a body mounted to an exterior of the top wall of the housing by the pivot and pivotal in a lateral direction perpendicular to the insertion direction; and a locking portion connected to a first side of the body for engaging with the mating connector to lock the electrical connector and the mating connector;

a releasing mechanism providing a releasing force to drive the locking mechanism to move from a locked state to a released state to allow the electrical connector to be disengaged from the mating connector; and a cover disposed on an outer wall of the housing and at least partially over the locking mechanism, the cover defining an elastic arm arranged over and engaging with the body for biasing the locking mechanism into the locked state in response to a removal of the releasing force acting on the locking mechanism.

6. The electrical connector of claim 5, wherein the locking portion includes a locking arm extending from the first side of the body in the insertion direction and a locking protrusion disposed at a free end of the locking arm, the locking protrusion inserted in the mating housing of the mating connector and into a locking groove of the mating housing.

7. The electrical connector of claim 6, wherein the top wall of the housing has a downwardly recessed receiving groove, the locking arm is received in the receiving groove.

8. The electrical connector of claim 6, wherein the locking mechanism has a pair of legs extending downwardly from a pair of opposite ends of the body and below a bottom wall of the housing, the releasing mechanism is connected to a pair of free ends of the legs, the releasing mechanism driving the locking mechanism to move from the locked state to the released state by pulling the free ends in a direction opposite to the insertion direction.

9. The electrical connector of claim 8, wherein the releasing mechanism has an actuating portion shaped to be pulled by an external tool and a connecting portion connected to the actuating portion and to the free ends of the legs of the locking mechanism below the bottom wall of the housing.

10. The electrical connector of claim 9, wherein the connecting portion has a pair of annular ears connected to the free ends of the legs.

11. The electrical connector of claim 10, wherein each of the free ends of the legs has a securing projection preventing one of the annular ears from being disengaged therefrom.

12. The electrical connector of claim 6, wherein the housing includes an upper housing, on which the body of the locking mechanism is disposed, and a lower housing fitted to the upper housing to define the receiving passage, a pair of opposing through holes are formed in the upper housing and the lower housing and the pivot is mounted in the through holes.

13. The electrical connector of claim 6, wherein the cover defines a shielding case disposed around the housing and shaped to be mated with the mating connector, the shielding case including:

a pair of horizontal top plates oppositely disposed and spaced apart from each other, the free end of the locking arm disposed in a gap between the top plates, the top plates having a plurality of first fingers spaced apart from one another and each extending obliquely upward;

a pair of vertical side plates oppositely disposed and extending downwardly from the top plates, the side plates having a plurality of second fingers spaced apart from one another and each formed into a V-shape; and a horizontal bottom plate connected between the side plates and opposite to the top plates, the bottom plate having a plurality of third fingers spaced apart from one another and each extending obliquely downward.

14. The electrical connector of claim 13, wherein the elastic arm extends above the body from the top plates in a direction opposite to the insertion direction.

15. The electrical connector of claim 6, wherein the locking mechanism has a releasing arm extending from a second side opposite to the first side of the body in a direction opposite to the insertion direction, the releasing mechanism is connected to the releasing arm to drive the locking mechanism.

16. The electrical connector of claim 15, wherein a mating groove is disposed on a lower side of the releasing arm, the releasing mechanism includes:

an actuating portion shaped to be pulled by an external tool; and a driving portion connected to the actuating portion, a free end of the driving portion having a wedge-shaped protrusion projecting obliquely upward in the direction opposite to the insertion direction, the wedge-shaped protrusion is at least partially received in the mating groove to drive the releasing arm to rotate in response to movement of the actuating portion in the direction opposite to the insertion direction, driving the lock mechanism to move from the locked state to the released state.

17. The electrical connector of claim 16, wherein the releasing mechanism includes a hollow annular portion obliquely disposed between the actuating portion and the driving portion and allowing a cable to be inserted into the housing to pass therethrough, and/or the releasing mechanism includes a pair of limiting protrusions protruding outward from a pair of opposite sides of the driving portion in a direction perpendicular to the insertion direction, a pair of limiting grooves are formed on the top wall of the housing, the limiting protrusions are received in the limiting grooves to limit a moving distance of the releasing mechanism in a direction parallel to the insertion direction.

18. The electrical connector of claim 15, wherein the cover comprises a horizontal cover body mounted over an outer wall of the housing and retaining the pivot of the locking mechanism in a mounting slot formed in an outer side of the top wall of the housing.

19. The electrical connector of claim 18, wherein the elastic arm is disposed in an opening formed in the cover body and extending above the locking arm of the locking mechanism in the insertion direction.

20. The electrical connector of claim 18, wherein the cover includes a pair of side walls extending downwardly from a pair opposite sides of a body of the cover, each of the side walls of the cover having a limiting notch opening downwards, the limiting notches cooperating with the mounting slot formed in the outer side of the top wall of the housing to retain the pivot between the cover and the housing.

* * * * *